United States Patent [19]

Remy

[11] 4,372,689

[45] Feb. 8, 1983

[54] ELECTRONIC WATCH MOVEMENT

[75] Inventor: Grandjean Rémy, Fontainemelon, Switzerland

[73] Assignee: Ebauches, S.A., Switzerland

[21] Appl. No.: 200,325

[22] Filed: Oct. 24, 1980

[30] Foreign Application Priority Data

Oct. 25, 1979 [CH] Switzerland ..... 9580/79

[51] Int. Cl.[3] ..... G04C 15/00; G04B 1/00

[52] U.S. Cl. ..... 368/155; 368/204

[58] Field of Search ..... 368/62, 66, 85–87, 368/155–160, 185, 187, 203–204, 217–219; 73/6

[56] References Cited

U.S. PATENT DOCUMENTS 4,001,553 1/1977 Troutman et al. ..... 368/217 X 4,040,247 8/1977 Haydon ..... 368/156

4,094,136 6/1978 Aizawa ..... 368/85

4,150,537 4/1979 Mochizuki et al. ..... 368/156

*Primary Examiner*—Vit W. Miska

*Attorney, Agent, or Firm*—Allegretti, Newitt, Witcoff & McAndrews

[57] ABSTRACT

A device for supplying the watch movement which comprises a time base (1) and a frequency divider (2) producing at least two signals (c), (d) at different frequencies. The two signals supply a logic selection device (3) of which the output supplies the circuit (5) for controlling the display of the timepiece movement.

An actuating device (4) controls the selection device (3) in such a way that a pulse in the supply voltage causes the circuit (5) for controlling the display to be supplied by one signal (c) or the other signal (d) of the frequency divider (2) and thus causes the display to operate at different speeds.

6 Claims, 4 Drawing Figures

TIME BASE
1
FREQUENCY DIVIDER
2
32 Hz
1 Hz
SELECTION CIRCUIT
3.
DETECTION CIRCUIT
4
DRIVE PULSE GENERATOR
5.
6
7
8
9
10
11
12
13.
14
15
16
17
18
19
25
26
Vp
0V.
h
g

FIG.2
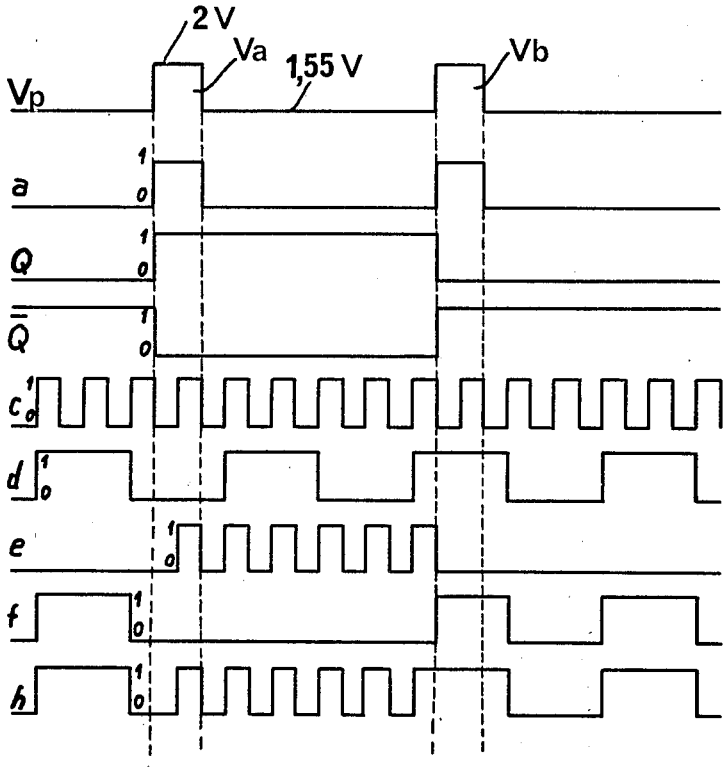
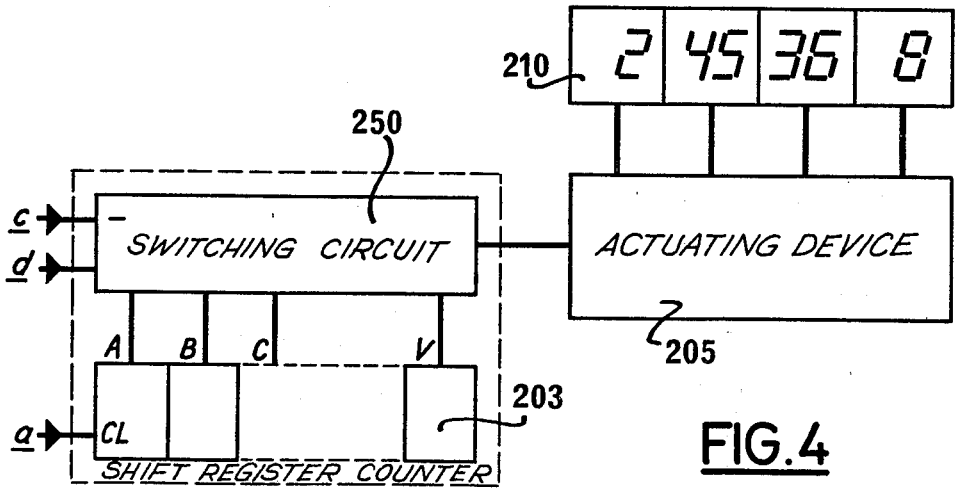
FIG.4

COUNTER
DECODER
106
105
118
110
103
SELECTION CIRCUIT
137
136
135
134
133
132
131
122
121
DETECTION CIRCUIT
104
104 a
111
112
a
FREQUENCY DIVIDER
102
TIME BASE
101

ELECTRONIC WATCH MOVEMENT

BACKGROUND OF THE INVENTION

The present invention concerns an electronic watch movement of the type comprising a time base circuit, a frequency divider circuit which is supplied by the time base, an actuating circuit connected to the divider circuit, a display system actuated by the actuating circuit and voltage input terminals which can be connected to an internal source or to an external source so as to supply the various circuits of the movement.

At the end of the operations of producing a timepiece movement comprising either an electric motor and an analog display by means of hands, or a digital display, it is desirable to carry out tests such as checking the torque of the motor, the minimum supply voltage, motor consumption, and activation of the segments of the display and the alarm or the chronograph. This is generally effected by acting on means external to the circuit by way of supplementary terminals of the integrated circuit, which are provided for that purpose. It is therefore necessary for the movement to have switching members which may be push buttons or external terminals to which a logic signal is applied. The push buttons or the terminals must be connected to one or more supplementary terminals of the integrated circuit. It is evident that such means are relatively heavy and complicated. A push button is a troublesome device, while an external terminal has disadvantages from the point of view of insulation of the timing arrangement. In addition, supplementary input terminals on the integrated circuit take up a great deal of space and the number thereof should be kept to a minimum.

BRIEF SUMMARY OF THE INVENTION

The object of the present invention is to provide timepiece movement which can be tested at the end of production without using additional terminals or switching means.

Accordingly, the electronic watch movement of this invention comprises a detecting circuit connected to the voltage terminals for generating a logic signal in response to a given signal supplied at said terminals, and a selection circuit responding to said logic signal for producing at least one control signal applied to at least one of the watch circuits.

BRIEF DESCRIPTION OF THE DRAWINGS

The accompanying drawings diagrammatically show by way of example some illustrative embodiments of the timepiece movement according to the present invention, in which:

FIG. 2 shows the form of the electrical voltages at various points in the timepiece movement of FIG. 1, FIG. 4 is an alternative form of the embodiment of FIG. 3.

DETAILED DESCRIPTION OF THE PREFERRED EMBODIMENTS

Figure 1:
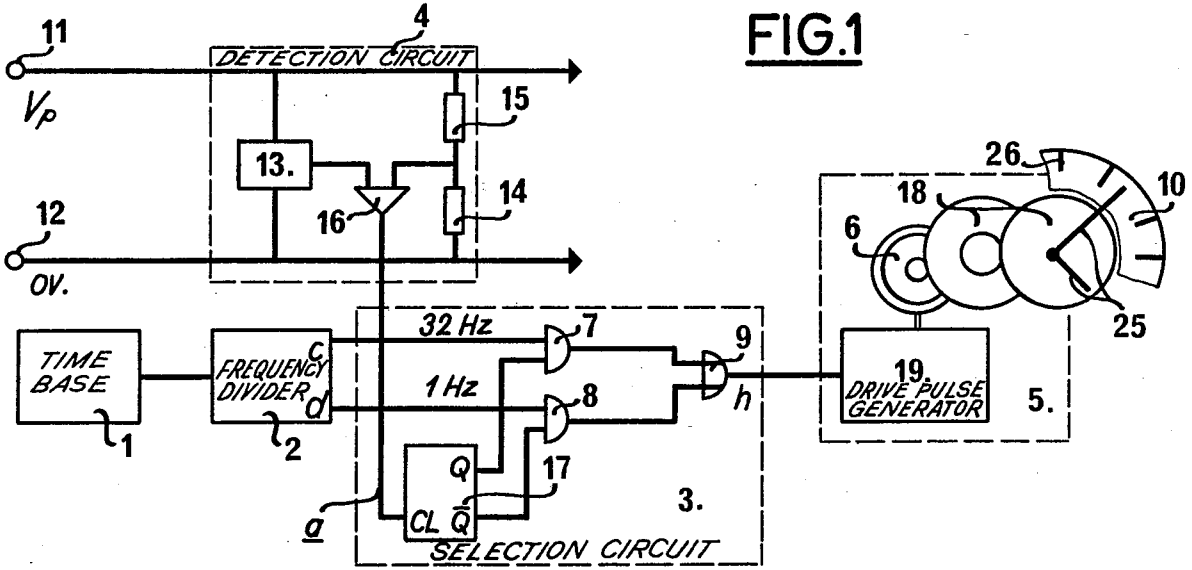
FIG. 1 is a block circuit diagram of an illustrative electronic timepiece movement with analog display, in accordance with the invention.

The analog display timepiece movement of FIG. 1, with means for checking the arrangement at the end of production thereof, has a circuit which can feed its motor at two different frequencies, one being the normal operating frequency and the other being an accelerated frequency for setting the time of the timepiece, for example.

The timepiece movement comprises a time base circuit 1 of any known type, which supplies a frequency divider circuit 2 which is also of known type and which supplies at two separate outputs c and d, signals at different frequencies, for example at **2*d* a 1 Hz signal and at 2*c*** a 32 Hz signal, both being of a duration of 7.8 ms.

The two outputs c and d of the frequency divider circuit 2, by way of a selection circuit 3 which is driver-controlled by a detection circuit 4, supply means 5 for actuating the display system 10, in the present case hands or pointers 25 co-operating with a dial 26. The actuating means 5 comprises a circuit 19 for generating drive pulses, a motor 6 connected to the circuit 19, and a train of wheels 18 which is activated by the motor 6 and which actuates the display system 10.

The selection circuit 3 comprises two AND-gates 7 and 8 and a flip-flop or bistable switching means 17. The two inputs of gate 7 are respectively connected to the output c of the divider circuit 2 and to the output Q of the flip-flop 17. The two inputs of gate 8 are respectively connected to the output d of the divider circuit 2 and to the output $\overline{Q}$ of the flip-flop 17.

The outputs e and f of the gates 7 and 8 supply the two inputs of an OR-gate 9 whose output supplies the means 5 for actuating the display system 10.

The selection circuit 3 is controlled by a detection circuit 4 which is itself connected to the two input terminals 11 and 12 to which a voltage source internal of the watch (battery) may be connected or to which a voltage source external to the watch may be connected, in the production or checking operations. The external source is referred to as a "false battery" by the man skilled in the art. The voltage applied to the terminals 11 and 12 supplies a reference voltage source 13 and a voltage divider formed by two equal resistors 14 and 15. A voltage comparison means 16 compares the voltage supplied by the reference source 13 and the voltage at a middle point of the divider 14 and 15, and produces a signal a which is applied to the clock input CL of the flip-flop 17. All the circuits and electrical components of the movement are also supplied from the input terminals 11 and 12.

The mode of operation of the illustrative timepiece movement of FIG. 1 will now be described with reference to FIG. 2.

In normal operation, the reference voltage source 13 produces a constant voltage of 0.9 V and the supply voltage Vp is 1.55 V, so that the middle point of the divider 14 and 15 is set at a voltage of 0.775 V, which is a lower value than the reference voltage (0.9 V). Thus, the output of the voltage comparison means 16 is in logic state 0. The flip-flop 17 has been set to zero by means (not shown), when voltage is applied to the circuit. It follows that its output Q is at state 0, while its output $\overline{Q}$ is at state 1; the gate 7 is closed while the gate 8 is open.

The gate 8 therefore passes the 1 Hz signal supplied by the output d of the frequency divider 2, which occurs again at the output h of the OR-gate 9 for supplying the shaping circuit 19. The motor 6 therefore rotates at its normal speed, also causing the hands or pointers 25 to advance at their normal speed.

For the purposes of switching the motor 6 to accelerated operation, the supply voltage Vp is temporarily increased to 2 V. The effect of this pulse Va is that, the supply voltage going to 2 V, the middle point of the voltage divider 14 and 15 goes from 0.775 V to 1 V. The comparison means 16 then changes state and its output signal a goes to logic state 1. This change of state causes the flip-flop 17 to switch, reversing the logic state of the outputs Q and $\overline{Q}$.

The gate 7 is thus open while the gate 8 is closed and the 32 Hz signal at the output c of the frequency divider circuit appears at the output h of the OR-gate 9 causing the motor 6 to rotate in the accelerated mode, by way of the circuit 19.

A fresh pulse Vb of the supply voltage has the effect of switching the flip-flop 17 and the motor then resumes its normal speed.

The pulses Va and Vb may be applied to the voltage input of the timepiece movement, in a simple and practical manner. For this purpose, an outside voltage source or "false battery" is connected to the terminals 11 and 12 of the voltage input. A 2 V voltage pulse is generated by the external source, and the effect of that pulse is to switch the motor 6 to the rapid speed mode, permitting various functions of the movement to be rapidly tested. A second 2 V pulse from the external source permits the motor to be returned to its normal speed mode.

It should also be noted that the actuating circuit 19 of the motor 6 operates in the same manner, whether it is supplied at a fast or slow frequency, so that the pulses that it transmits to the motor are the same for both frequencies. Thus, operation of the motor in the fast frequency mode can be comparable to its operation in the slow frequency mode.

Figure 3:
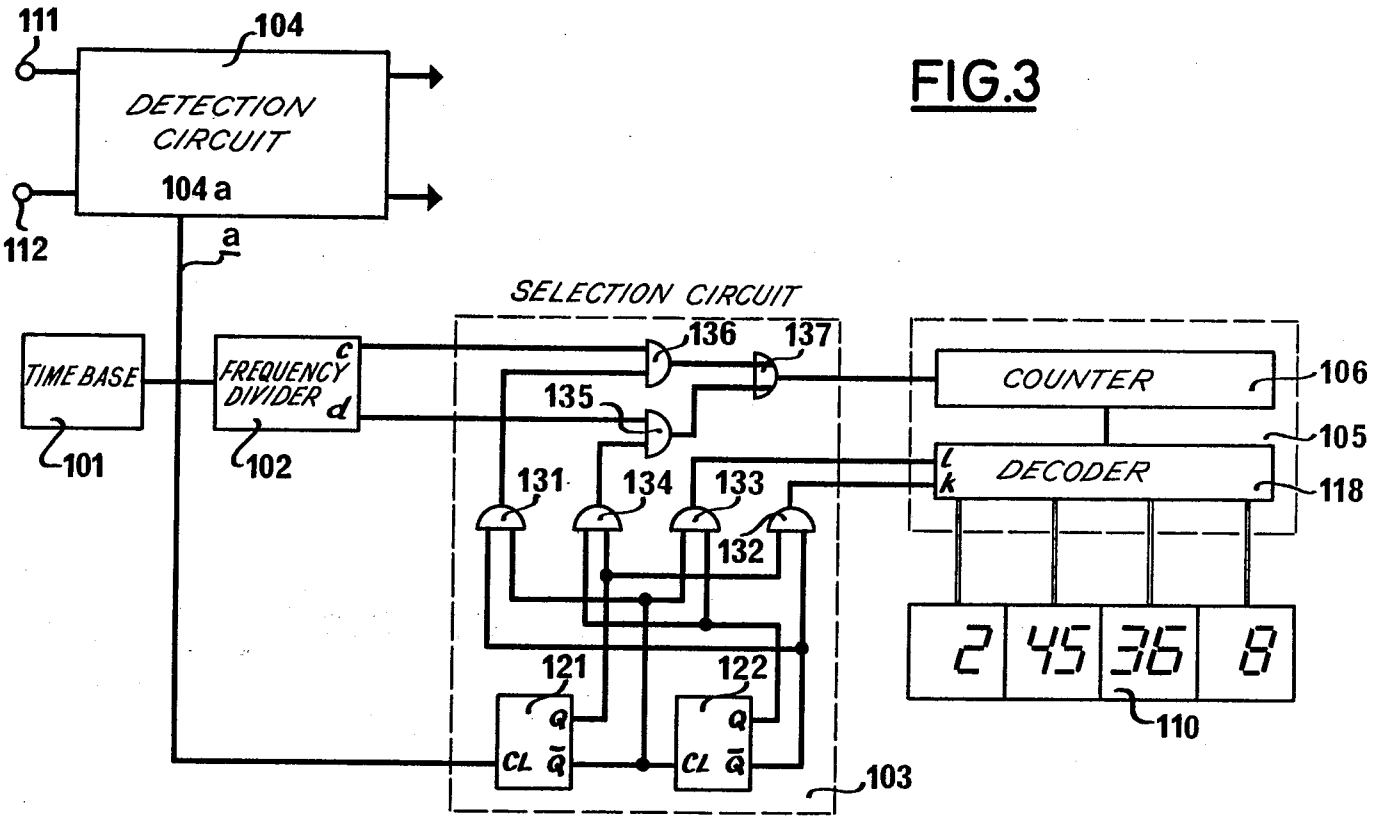
FIG. 3 is a block circuit diagram of an illustrative timepiece movement with digital display, according to the invention.

The timepiece movement in FIG. 3 comprises a time base 101 of known type which supplies a frequency divider 102 which is also of known type and which delivers, at a plurality of separate outputs, signals at different frequencies, for example at 102*c* a 1 Hz signal and a 32 Hz signal at 102*d*. These two outputs respctively supply the AND-gates 135 and 136 forming part of a selection circuit 103 and then, through the OR-gate 137, a circuit 105 for actuating the display system 110 which in the present case is a liquid crystal display. This actuating circuit, which is known per se, comprises at least one counter circuit 106 connected to the output of OR-gate 137 and a decoder circuit 118 connected to the counter circuit 106. The counter circuit 106 receives, for example, one pulse per second, and the decoder circuit of the display means activates the different segments of the display so as to form the different figures indicating seconds, minutes, hours and the date. The decoder circuit 118 also has two inputs 118*k* and 118*l* permitting the display to be checked: a logic 1 at the input 118*k* causes simultaneous activation of all the segments of the display 110; a logic 1 at the input 118*l* causes the entire display 110 to be extinguished.

The timepiece movement of FIG. 3 also comprises a detection circuit 104 which is identical to the circuit 4 of the analog display timepiece movement of FIG. 1, generating at its output 104*a* a signal a when the voltage at the terminals 111 and 112 exceeds a certain limit.

The signal a is transmitted to the input of the selection circuit 103. The circuit 103 comprises two series-connected flip-flops 121 and 122, the output $\overline{Q}$ of the flip-flop 121 being connected to the input CL of the flip-flop 122. The output 121Q of the flip-flop 121 is connected to one of the inputs of the AND-gates 132 and 134. The output 121$\overline{Q}$ of the flip-flop 121 is connected to one of the inputs of the AND-gates 131 and 133. The output 122$\overline{Q}$ of the flip-flop 122 is connected to the second input of the AND-gates 133 and 134. The output 122$\overline{Q}$ of the flip-flop 122 is connected to the second input of the gates 131 and 132.

The input of the selection circuit 103 is at the same time the input CL of the flip-flop 121. In the absence of a signal a at 121 CL, the two flip-flops, which have been reset to zero (by means which are not shown) when voltage is applied to the circuit, display a logic 1 at their outputs $\overline{Q}$ which, being connected to the AND-gate 131 produce a logic 1 at the output of that gate and consequently a logic 1 at the second input of the gate 135. The gate 135 passes the 1 Hz signal which, passing through the OR-gate 137, supplies the actuating device 105 for normal operation of the watch movement. It can readily be appreciated that the three other AND-gates 132–134 are closed and that consequently a logic 0 is applied to the second input of the AND-gate 136 which is closed. A first signal a at the input CL of the flip-flop 121 causes it to switch while the flip-flop 122 remains in its previous state. A logic 1 is now present at the outputs 121Q and 122$\overline{Q}$ setting the two inputs of the AND-gate 132 at state 1 and displaying a 1 at the input k of the decoder 118 controlling activation of all the segments. A second signal a at input 121 CL causes the two flip-flops 121 and 122 to switch and a logic 1 is displayed at 121$\overline{Q}$ and at 122Q, thus setting the two inputs of the AND-gate 133 to state 1 and consequently setting the input 1 of 118 to 1, which causes all the segments to be extinguished. A third signal a causes the flip-flop 121 to switch, while maintaining the flip-flop 122 in its previous state. The outputs 121Q and 122Q display a logic 1, which opens the AND-gate 134 and sets a logic state 1 at the second input of the AND-gate 136. The latter gate, being opened, passes the 32 Hz signal which, passing through the OR-gate 137, operates the actuating circuit 105 and the display means 110 in the accelerated operating mode. A fourth signal a at input 121 CL causes the two flip-flops 121 and 122 to switch, and the arrangement returns to the initial position, with the AND-gate 131 opened and the second input of the gate 135 at state 1.

It is therefore possible, by means of this novel circuit, selectively to actuate normal operation, simultaneous activation of all the segments of the display (lamp test), extinction of all the segments (blank test) and accelerated operation of the display.

It is evident that the arrangement having two flip-flops, as indicated at 103, can be replaced by a shift register counter 203 (see FIG. 4). The latter may have a large number of outputs A, B, C, . . . V permitting checking operations which are more complex than those described above to be effected. These outputs are connected to a switching circuit 250 similar to that comprising the gates 135, 136 and 137 in FIG. 3. The circuit 250 is connected to the actuating device 205 which itself supplies the display. By means of this circuit, all the functions of the timing arrangement can be sequentially energized: chronograph, alarm, countdown, setting the date and the time, a change in time zone, etc.

Finally, two voltage pulses at the terminals 111 and 112 can be applied at highly precise intervals of time, thereby permitting checking of the operation of the watch movement.

In the above-described examples, all these checking operations were controlled by an increase in the supply voltage, but it will be appreciated by those skilled in the art that they could be triggered off by a reversal of the polarity at the input terminals 11 and 12 or 111 and 112. It also will be understood that a reduction in voltage could be envisaged for producing an actuating signal, although this mode of procedure suffers from certain disadvantages in comparison with the above-described examples. It only has to be realized that a reduction in voltage due to a shock having repercussions on the fixing of the battery would trigger off the accelerated operating mode of the motor, in the FIG. 1 embodiment. However, it is also clear that these apparent disadvantages could be overcome by suitable circuits.

Various modifications may be made in the form of the invention without departing from the spirit and principles of the invention as disclosed in the foregoing illustrative embodiment. It therefore is intended that the accompanying claims be construed as broadly as possible to cover various embodiments of the invention as is consistent with the prior art.

What is claimed is:

1. An electronic watch movement comprising a time base circuit, a frequency divider circuit supplied by the time base, an actuating circuit connected to said divider circuit, a display system actuated by said actuating circuit, voltage input terminals adapted to be connected to an internal voltage source or to a external voltage source thereby to supply said circuits, said external voltage being different from said internal voltage a detecting circuit connected to the voltage input terminals for generating a logic signal in response to said external voltage and a selection circuit responsive to said logic signal for producing at least one test signal applied to said actuating circuit.

2. A watch movement according to claim 1 wherein said detecting circuit comprises a reference voltage source and means for comparing said reference voltage to the voltage at said input terminals.

3. A watch movement according to claim 1 wherein said detecting circuit comprises a reference voltage source, a voltage divider connected to said input terminals and a voltage comparison means supplied by said reference source and the middle point of said divider.

4. A watch movement according to claim 1 wherein said selection circuit comprises a bistable switching means which changes state when it receives said logic signal and a switching circuit responsive to the change in state of said switching means by passing to the actuating circuit a test signal for permitting accelerated operation of said display system.

5. A watch movement according to claim 4 wherein said selection circuit further comprises a second bistable switching means which changes state in response to the change in state of the first bistable switching means, and a second switching circuit which is responsive to the change of state of the first and second switching means by passing a test signal to the actuating circuits.

6. A watch movement according to claim 1 wherein said selection circuit comprises a shift register counter which sequentially passes an activation signal on each of its outputs each time that it receives said logic signal, and a switching circuit which receives said activation signal on one of its inputs and which transmits an a test signal to the actuating circuit.

* * * * *